US007997866B2

(12) United States Patent
Naik et al.

(10) Patent No.: US 7,997,866 B2
(45) Date of Patent: Aug. 16, 2011

(54) GAS TURBINE AIRFOIL WITH LEADING EDGE COOLING

(75) Inventors: Shailendra Naik, Gebenstorf (CH); Gregory Vogel, Palm Beach Gardens, FL (US)

(73) Assignee: ALSTOM Technology Ltd., Baden (CH)

( * ) Notice: Subject to any disclaimer, the term of this patent is extended or adjusted under 35 U.S.C. 154(b) by 1007 days.

(21) Appl. No.: 11/838,960

(22) Filed: Aug. 15, 2007

(65) Prior Publication Data

US 2008/0095622 A1 Apr. 24, 2008

Related U.S. Application Data

(60) Provisional application No. 60/823,511, filed on Aug. 25, 2006.

(51) Int. Cl.
*F01D 5/08* (2006.01)

(52) U.S. Cl. ..... 416/97 R

(58) Field of Classification Search ..... 415/115; 416/97 R

See application file for complete search history.

(56) References Cited

U.S. PATENT DOCUMENTS

| | | | | |
|---|---|---|---|---|
| 5,374,162 | A * | 12/1994 | Green | 416/97 R |
| 5,609,779 | A * | 3/1997 | Crow et al. | 219/121.71 |
| 5,779,437 | A | 7/1998 | Abdel-Messeh et al. | |
| 6,176,676 | B1 * | 1/2001 | Ikeda et al. | 415/115 |
| 6,183,199 | B1 * | 2/2001 | Beeck et al. | 416/97 R |
| 6,918,742 | B2 * | 7/2005 | Liang | 415/115 |
| 2006/0073015 | A1 * | 4/2006 | Liang | 416/97 R |

FOREIGN PATENT DOCUMENTS

| | | |
|---|---|---|
| EP | 0924384 | 6/1999 |
| EP | 1645721 | 4/2006 |

* cited by examiner

*Primary Examiner* — Ninh H Nguyen

(74) *Attorney, Agent, or Firm* — Cermak Nakajima LLP; Adam J. Cermak

(57) ABSTRACT

A gas turbine airfoil (1) includes a pressure sidewall (15) and a suction sidewall (16), extending from a root to a tip and from a leading edge region to a trailing edge and having at least one cooling passage between the pressure sidewall (15) and the suction sidewall (16) for cooling air to pass through and cool the airfoil from within. One or several of the cooling passages (3) extend along the leading edge of the airfoil (1) and several film cooling holes (1,2) extend from the internal cooling passages (3) along the leading edge region to the outer surface of the leading edge region. The film cooling holes (1,2) each have a shape that is diffused in a radial outward direction of the leading edge of the airfoil (1) at least over a part of the length of the film cooling hole (1,2). Improved cooling in the leading edge region can be achieved because the cooling holes (1, 2) have a principal axis (17), and the shape is asymmetrically diffused in that it is diffused in the radial outward direction from the principal axis (17) along a forward inclination axis (20), and it is additionally diffused in a second lateral direction from the principal axis (17) along a lateral inclination axis (21).

24 Claims, 9 Drawing Sheets

C

GAS TURBINE AIRFOIL WITH LEADING EDGE COOLING

This application claims priority under 35 U.S.C. §119 to U.S. Provisional Application No. 60/823,511, of 25 Aug. 2006, the entirety of which is incorporated by reference herein.

BACKGROUND OF THE INVENTION

1. Field of the Invention

This invention pertains to a gas turbine airfoil and in particular to a cooling construction for its leading edge.

2. Brief Description of the Related Art

Airfoils of gas turbines, turbine rotor blades, and stator vanes, require extensive cooling in order to keep the metal temperature below a certain allowable level and prevent damage due to overheating. Typically such airfoils are designed with hollow spaces and a plurality of passages and cavities for cooling fluid to flow through. The cooling fluid is typically air bled from the compressor having a higher pressure and lower temperature compared to the gas travelling through the turbine. The higher pressure forces the air through the cavities and passages as it transports the heat away from the airfoil walls. The cooling construction further usually includes film cooling holes leading from the hollow spaces within the airfoil to the external surfaces of the leading and trailing edge as well as to the suction and pressure sidewalls.

The leading edge of a turbine blade is one of the areas that faces the hottest gas flow conditions, and is thus one of the most critical areas to be cooled. It also has the particularity to have a strong surface curvature and thus a highly accelerated flow from each side of the stagnation line. For very hot gas temperature conditions, cooling the leading edge with an internal cooling passage is usually not sufficient, requiring additional rows of holes drilled into the leading edge to pick-up some heat directly through the holes and to provide a layer of coolant film on the external surface. However the interaction of the coolant flow ejected from theses rows of holes and the main hot gas flow can be difficult to predict, especially in situations where the stagnation line position can be uncertain due to changes of incidence angles. For this reason extensive studies have been performed on several leading edge film cooling configurations, including cylinders and blunt body models that simulate the leading edge of a turbine airfoil.

In the state of the art generally, the film cooling holes extending from cooling passages within the airfoil to the leading edge are positioned at a large angle to the leading edge surface and are designed with a small length to diameter ratio. Typically, the angle between the cooling hole axis and the leading edge surface is significantly greater than 20 degrees and the ratio of the cooling hole length to the cooling hole diameter is about 10, typically less than 15. Such holes are drilled by an electro-discharge machining process and, more recently, by a laser drilling process. Such film cooling holes provide good convective cooling of the leading edge of the airfoil due to the cumulative convective cooling area of all the film cooling holes together that are positioned between the root and the tip of the airfoil leading edge. The cooling air that exits the film cooling holes provides further cooling by means of a film that passes along the surface of the airfoil leading edge.

The establishment of a cooling film by a number of exit holes along the leading edge is sensitive to the pressure difference across the exit holes. While too small a pressure difference can result in an ingestion of hot gas into the film cooling hole, too large a pressure difference can result in the cooling air blowing out of the hole and will not reattach to the surface of the airfoil for film formation.

Furthermore, the short length-to-diameter ratio of the film cooling holes and the large angle between the hole axes and the leading edge surface can lead to the formation of vortices about the exit holes. This results in a high penetration of the cooling film away from the surface of the airfoil and in a decrease of the film cooling effectiveness about the leading edge of the airfoil.

One way to provide better film cooling of the airfoil surface is to orient the film cooling holes at a shallower angle with respect to the leading edge surface. This would decrease the tendency of vortex formation. However, a more shallow angle results in a larger length to diameter ratio of the film cooling hole, which exceeds the capabilities of today's laser drilling machines.

EP 0 924 384 discloses an airfoil with a cooling construction of the leading edge of an airfoil that provides improved film cooling of the surface. The disclosed airfoil includes a trench that extends along the leading edge and from the root to the tip of the airfoil. The apertures of the film cooling holes are positioned within this trench in a continuous straight row. The cooling air bleeds to both sides of these apertures and provides a uniform cooling film downstream and to both sides of the airfoil.

U.S. Pat. No. 5,779,437 provides a cooling system for the showerhead region, in which there is a multitude of passages, wherein each passage has a radial component and a downstream component relative to the leading edge axis, and the outlet of each passage has a diffuser area formed by conical machining, wherein the diffuser area is recessed in the wall portion downstream of the passage.

EP 1 645 721 discloses an airfoil having several film cooling holes at the leading edge with exit ports. The film cooling holes have a sidewall that is diffused in the direction of the tip of the airfoil at least over a part of the film cooling hole. Furthermore, the film cooling holes each have flare-like contour near the outer surface of the leading edge. The film cooling holes are stated to provide an improved film cooling effectiveness due to reduced formation of vortices and decreased penetration depth of the cooling air film.

SUMMARY OF THE INVENTION

One of numerous aspects of the present invention includes providing an improved cooling structure for the leading edge of a turbine airfoil.

Specifically, aspects of the present invention relate to the improvement of a gas turbine airfoil with a pressure sidewall and a suction sidewall, extending from a root to a tip and from a leading edge region to a trailing edge and having at least one cooling passage between the pressure sidewall and the suction sidewall for cooling air to pass through and cool the airfoil from within. Additionally, one or several of the cooling passages extend along the leading edge of the airfoil and several film cooling holes extend from the internal cooling passages along the leading edge region to the outer surface of the leading edge region, wherein the film cooling holes each have a shape that is diffused in a radial outward direction of the leading edge of the airfoil at least over a part of the length of the film cooling hole.

An improvement of a structure of this kind is achieved by providing cooling holes the exits of which are asymmetrically diffused in two different directions. Specifically, the cooling holes comprise a principal axis (usually defined by a cylindrical section of the cooling holes which is located in the entry region, i.e., adjacent to the internal cooling passage), and in that the shape is asymmetrically diffused on the one hand in a radial outward direction tilted away from the principal axis along a forward inclination axis, and on the other hand in a second, lateral direction (being different from the forward inclination direction) tilted away from the principal axis along a lateral inclination axis.

Another aspect of the present invention therefore includes that, in contrast to the state-of-the-art, where either the cooling holes are simply conically widening at their exit, or are selectively conically widening in a radial direction only, according to the invention specifically two (or more) directions are defined in which the opening of the cooling holes is widening. On the one hand, there is the widening in the radial direction which leads to the asymmetry along the radial direction as defined by the forward inclination axis. On the other hand, there is the lateral widening, usually perpendicular to the radial direction and downstream of the hot gas flow, away from the stagnation line, as defined by the lateral inclination axis. Using this twin widening shape of the exit portion, selectively and very efficiently on the one hand, film cooling is provided downstream of the cooling hole in a radial direction, and additionally in the direction of the hot gas which impinges onto the shower head region, i.e., onto the leading edge region, and travels to the trailing edge, so in the lateral direction, which is essentially perpendicular to the stagnation line along the leading edge.

A first preferred embodiment of the cooling holes according to the present invention is characterised in that the shape of the cooling holes is diffused essentially cylindrically (or slightly conically) in the radial outward direction along the forward inclination axis. Alternatively or additionally, the shape is diffused essentially cylindrically (or slightly conically) in the second, lateral direction along a lateral inclination axis. Thereby, preferably, the shape or diffusion portion surface between the two cylindrical diffusion sections is smoothed, e.g., via connecting surfaces which are preferably essentially tangential to both cylindrical diffusion sections along the two different directions.

According to a further preferred embodiment, the principal axis is radially inclined by 50-70° from the horizontal plane, so from the surface of the airfoil at the location of the cooling hole. So the angle $\alpha$ between the plane and this principal axis is an acute angle in the range of 20-40°. It is also possible to incline the principal axis along a downstream (or opposite) component relative to the leading edge, e.g., with an inclination angle of 85-105° to the normal to the horizontal plane in a direction essentially perpendicular to the radial direction; preferably, however, the principal axis is only radially inclined and parallel to the stagnation line.

According to a further preferred embodiment, the forward inclination axis is tilted from the principal axis towards the radial direction of the airfoil (so, in a radial direction and towards the surface of the airfoil), and in that the angle $\beta$ between the principal axis and the forward inclination axis is in the range of 5-20°, preferably in the range of 5-15°. If, as preferred, the principal axis encloses an angle $\alpha$ with the plane of about 30°, the angle between the forward inclination axis and the plane is in the range of 10-25°.

A further preferred embodiment includes a lateral inclination axis tilted from the principal axis along a direction essentially perpendicular to a stagnation line on the leading-edge and in the downstream direction, and the angle $\gamma$ between the principal axis and the lateral inclination axis is in the range of 5-20°, preferably in the range of 5-15°. If, as preferred, the principal axis is not inclined along a downstream component, this means that the lateral inclination axis encloses an angle in the range of 70-85° with the plane of the airfoil at the exit region of the cooling hole in the downstream direction.

Additionally it is preferred, when one row of cooling holes is located on the pressure side of the stagnation line and a second row of cooling holes is located on the suction side of the stagnation line. Preferably these two rows are equally distanced on both sides from the stagnation line. It could be shown that a particularly efficient cooling can be achieved when, in each of the rows, at least the plurality of the holes, preferably all of the holes, are equally distanced from the stagnation line. It is furthermore preferred when the cooling holes in the two rows are arranged in a staggered manner along the radial direction, wherein preferably they are staggered by one hole pitch from each other.

As concerns the distancing of the two rows from the stagnation line, a particularly efficient cooling can be achieved when each row of holes is located at least 3 hole diameters (the hole diameter generally defined as the whole diameter of the cylindrical section of the cooling hole) distanced from the stagnation line, preferably 3-3.5 hole diameters distanced from the stagnation line. In the radial direction, preferably, the cooling holes are distanced by at least 1 hole diameters, preferably in the range of 4-6 hole diameters (distancing normally calculated as indicated with y in FIG. 3, hole diameter normally taken as the diameter in the cylindrical or in the diffused area of the hole).

As already mentioned above, preferably and usefully the cooling holes have a cylindrical section at the entry portion facing the cooling passage. It is furthermore preferred that the diameters of the two cylindrical diffusions are equal or in the range of the diameter of the cylindrical section of the entry portion.

According to a further preferred embodiment, the cooling holes have a hole length-to-diameter ratio ranging from 2-6, wherein the diameter is taken as the diameter in the cylindrical or in the diffused area of the hole.

A further preferred embodiment is characterized in that the ratio of the cross-section in the widening portion of the holes to the cross-section in the cylindrical section of the holes is in the range of 1.5-2.45, preferably in the range of 1.8-2.0. Typically it is around 1.95.

The lateral inclination can be located at different positions along the forward direction of the cooling role. As a matter of fact, it can be located either at the two extremes given by the forward edge or the backward edge of the hole, or in the range between these extremes. So, according to a yet another preferred embodiment, the lateral inclination axis is located at or between a forward edge and a backward edge of the exit portion of the hole and preferably tilted from the principal axis along a direction such that essentially at the transition of the cylindrical and the widening portion the axis of the cylindrical section and the axis of the inclination cross.

As concerns possible methods for making such cooling hole structures, it is noted that such cooling hole structures can be formed by conventional drilling methods including electro-discharge machining, but preferably by laser drilling methods. The machining process can be carried out in that first a cylindrical, fully penetrating hole is machined defining the principal axis and thus, if present, the cylindrical section. Subsequently, two additional cylindrical machining steps are carried out along the lateral inclination axis and along the forward inclination axis. In the last step, the surface of the diffusion region of the cooling holes is smoothed. It is also possible to first generate the diffusion region by the two machining steps along the lateral inclination axis and along the forward inclination axis, respectively, and in a subsequent step to machine the fully penetrating hole defining the principal axis. Alternatively it is possible to produce these holes in a single step process, for example by using laser drilling or EDM-methods.

BRIEF DESCRIPTION OF THE DRAWINGS

In the accompanying drawings preferred embodiments of the invention are shown in which.

DETAILED DESCRIPTION OF EXEMPLARY EMBODIMENTS

Figure 1:
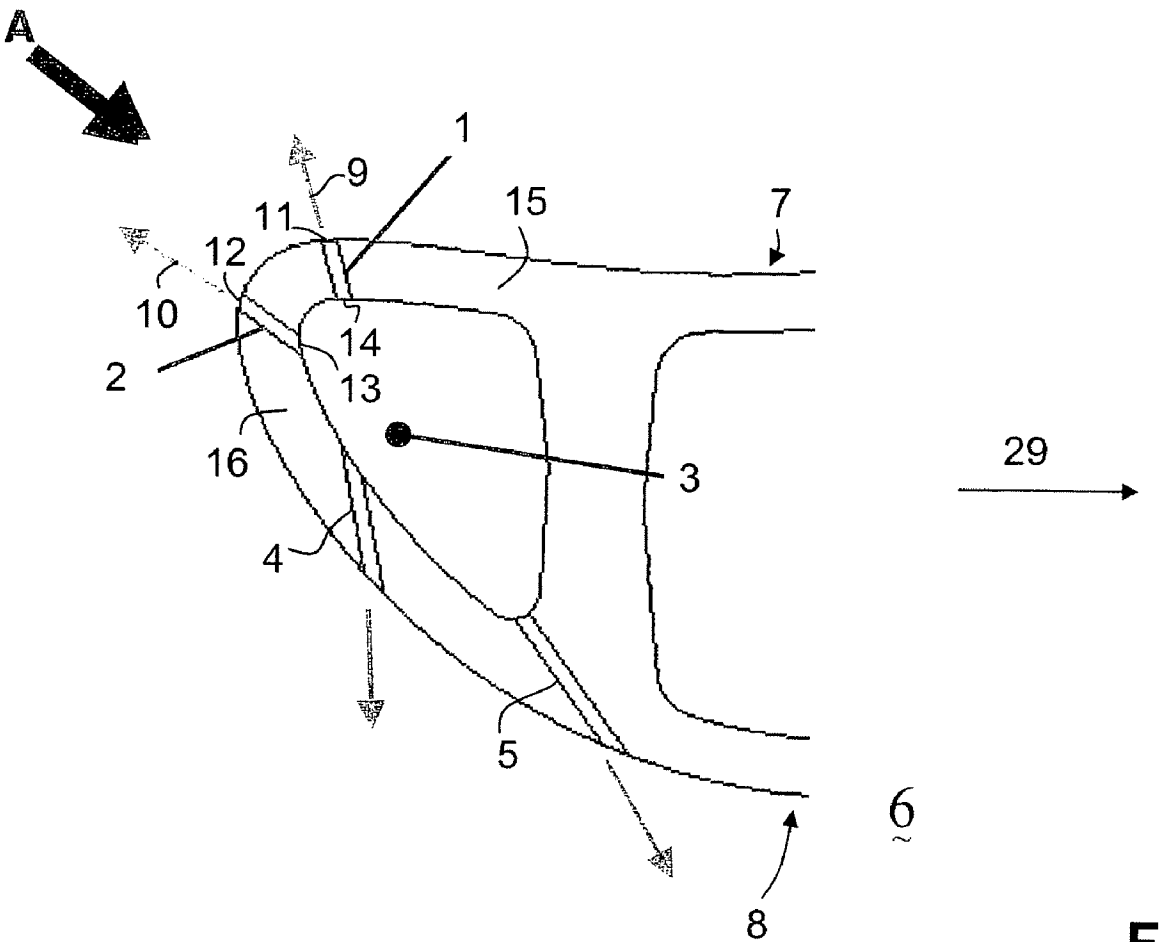
FIG. 1 is a cut through the leading edge region of a turbine airfoil in a plane perpendicular to the radial direction.

Referring to the drawings, which are for the purpose of illustrating the present preferred, exemplary embodiments of the invention and not for the purpose of limiting the same, FIG. 1 shows a cut essentially in a plane perpendicular to the radial direction of the row of gas turbine blades through the leading edge or shower head region of a gas turbine airfoil 6. The gas turbine airfoil 6 is given as a hollow body defined by a pressure side wall 15 and a suction sidewall 16, which at the leading edge converge in the shower head region or leading edge region, and which at the trailing edge 29 (not displayed) also converge.

Within the gas turbine airfoil 6 there is provided a plurality of cooling air passages, and in this specific embodiment there is provided one radial cooling air cooling air passage 3 in the leading edge region.

For cooling such an airfoil, on the one hand the internal circulation through the cooling air passages is effective, on the hand in addition to the internal cooling also film cooling is used, as in particular in the leading edge region, where the hot gases impinge onto the airfoil, overheating must be prevented. To this end in the specific embodiment as showed in FIG. 1, on the suction side 8 there is provided film cooling holes 4 and 5, one of which is located close to the leading edge, and the other one is located remote from the leading edge.

In the very region of the leading edge, there is provided two rows of cooling holes. On the one hand on the pressure side there is provided a first row of cooling holes 1, and on the suction side there is provided a second row of cooling holes 2. The cooling air which usually travels through the cooling air passage 3 in a radial direction enters these cooling holes 1, 2 via the corresponding entry portions 13 and 14, penetrates through the cooling holes and exits these via the exit portions 11 and 12 in the form of cooling air discharges 9 and 10, respectively.

In order to have an efficient film cooling effect of these cooling holes 1, 2 it is important to make sure that the cooling air discharge 9, 10 indeed forms a film which remains on the outer surface of the airfoil 6 and which is generated with as little vortices as possible.

Figure 2:
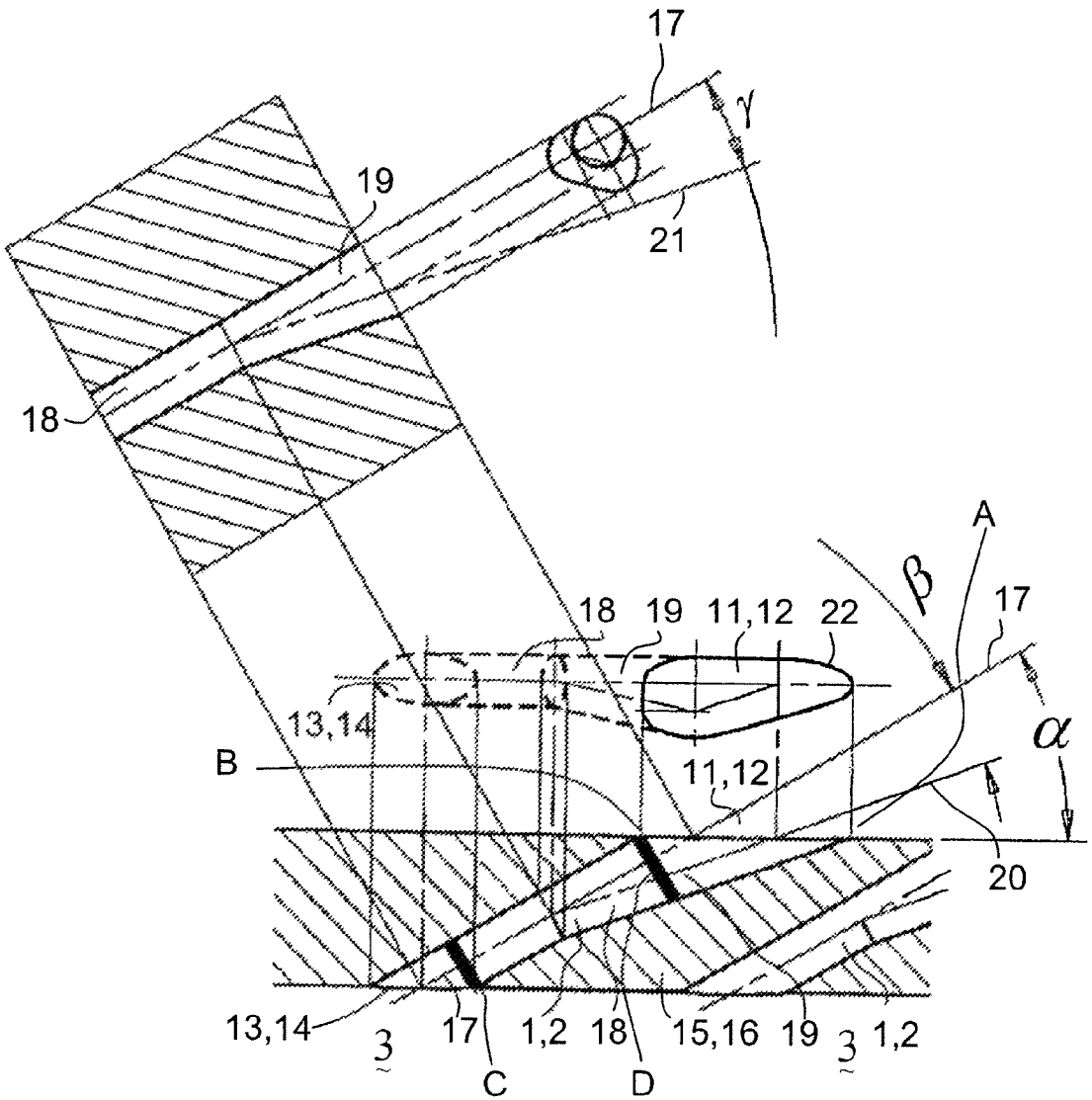
FIG. 2 displays cuts through a twin widened cooling hole according to the invention.

FIG. 2 shows the asymmetric structure of cooling holes as proposed in the present invention. These cooling holes have a widening portion 19, which however is structured in a very particular way. This widening portion 19 is not just a conical widening but it is an asymmetric widening with essentially asymmetry along two different directions.

The cooling hole 1,2 includes, in the region of the exit portion 12, 13, a cylindrical portion 18. This cylindrical portion 18 defines the principal axis 17 of the cooling hole 1, 2. As one can see from FIG. 2, this principle axis 17 is inclined with respect to the normal of the plane of the sidewall in this leading edge region. It is inclined from the normal to this plane in a radial direction, and this by an angle 90°-α, as indicated in FIG. 2. The angle α is ideally in the range of approximately 25-35°. This radial arrangement of the principal axis 17 on the one hand makes sure that the cooling gas flow as indicated with the arrow in the cooling air passage smoothly enters the cooling hole via the exit portion 11, 12. On the other hand it assures basically a vortex free formation of the film for film cooling, if used in conjunction with the further widening portion 19 as to be described below.

This widening portion 19 on the one hand includes a first widening along a forward inclination axis, as indicated with the reference no. 20. This forward inclination axis is even more tilted in the radial direction than the principal axis 17. As a matter of fact, both axes 17 and 20 are aligned in a radial plane, and the principal axis 17 and the forward inclination axis enclose an angle β, which is typically in the range of 10°. This widening portion, as defined by this forward inclination axis 20, is actually an essentially cylindrical bore with the axis 20 penetrating until the cylindrical portion 18 starts.

On the other hand there is a second asymmetry along a lateral direction, so along a downstream direction perpendicular to the stagnation line 25 as visible in FIG. 3 below. Also in this lateral direction this widening is defined by an axis, namely by the lateral inclination axis 21. This lateral inclination axis 21 encloses an angle γ with the principal axis 17.

It is noted that this lateral inclination can be located at different positions. So talking in a process mode it is, for example, possible to first machine the cylindrical section along the axis 17, and to then drill the forward inclination of along the axis 20. This then leads to a hole which has a forward edge A and a backward edge B. The lateral inclination can now either be drilled by starting at the forward edge A or by starting at the backward edge B, or in principle in the full range between these two positions. The situation as displayed in FIG. 2 is the one in which the lateral drilling was carried out starting from position B, so at the backward edge B.

Due to this tilting of the principal axis 17 in conjunction with the further tilt of the forward inclination axis 20 and the second tilt in a direction orthogonal to the radial direction along the lateral inclination axis 21, this leads to a highly asymmetric outline 22 of the exit of the cooling hole.

This results in two different cross sections, a first cross-section C in the cylindrical section, and second larger cross-section as indicated with D in FIG. 2 in the widening portion of the hole. Using these two parameters is possible to define an area ratio which is the ratio between D and C. This ratio is typically in the range of 1.5-2.45 and preferably in the range of 1.8-2.0, so typically around 1.9.

This highly asymmetric outline and the double-axis asymmetric widening of the widening portion 19 provides a highly efficient cooling film formation, essentially without vortexes and with a broad covering of the area downstream of the cooling hole 1, 2. In addition, it can be produced in a rather straightforward manner if in a first step, drilling is carried out with a conventional cylindrical drilling tool along the principal axis with a diameter corresponding to the diameter of the desired cylindrical portion, and to produce a fully penetrating cooling hole. In two subsequent steps, preferably using the same drilling tool, first the forward inclination is produced by drilling along the forward inclination axis 20, and then the lateral inclination is produced by drilling a second time along the lateral inclination axis 21. Subsequently one can, if at all necessary, smooth the internal surface of the widening portion 19, for example by tangentially joining the cylindrical portions generated in the triple boring process.

As mentioned above, it is, however, also possible to use single step methods to produce these holes, for example, to use laser drilling or EDM-methods.

Figure 3:
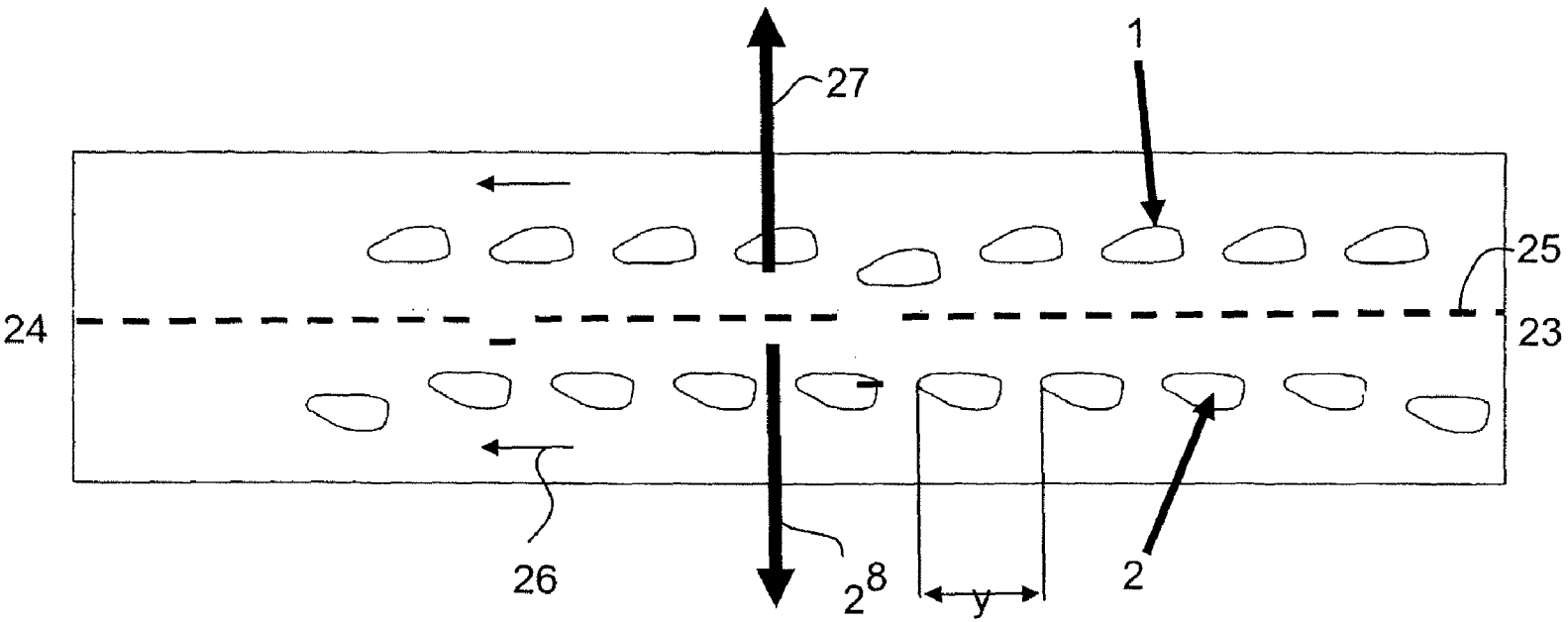
FIG. 3 shows a cooling hole arrangement in a view along the arrow A in FIG. 1.

Cooling holes as displayed in FIG. 2 can be arranged along the leading edge as displayed in FIG. 3. FIG. 3 is actually a view along the arrow A as given in FIG. 1, and it represents an unrolled view onto the surface of the airfoil. As one can see, the hot air, which basically impinges onto the surface along a direction, as also given by the arrow A in FIG. 1, is split into two hot gas flows 27 and 28, which travel along the pressure side and the suction side, respectively. The separation into these two flows essentially takes place along the so-called stagnation line 25, which is indicated in a dashed manner in FIG. 3.

The cooling holes are arranged in two rows which are located symmetrically on both sides of the stagnation line 25. The cooling holes are distanced from the stagnation line 25 approximately by 3.25 times the hole diameters (taken as the diameter C as defined above), and the two rows are arranged in a staggered manner, wherein the cooling holes are radially staggered by one hole pitch from each other. FIG. 3 shows a situation, in which the forward inclination angle $\beta$ is 10°, and in which the lateral inclination $\gamma$ is also 10°. The holes are spaced in the radial direction by the distance y, which is typically in the range of 4-6 hole diameters C.

Figure 4:
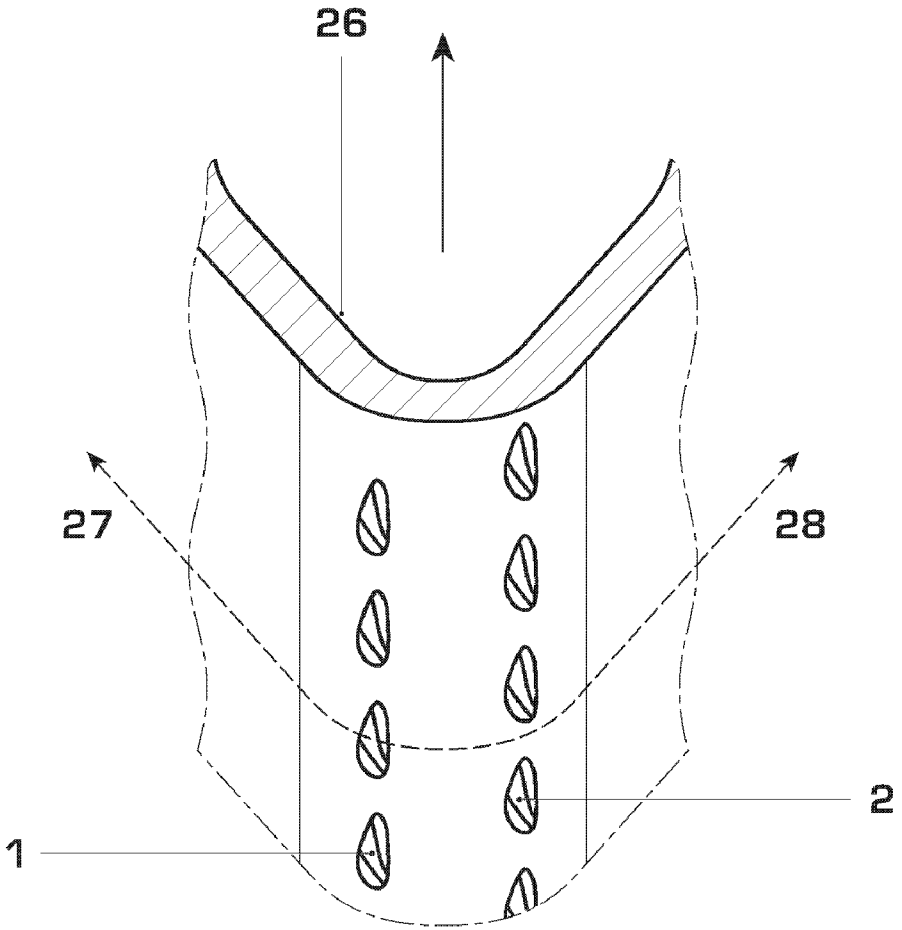
FIG. 4 shows a perspective schematic view onto a leading edge with cooling holes according to the invention.

FIG. 4 shows a perspective view onto the surface of such a leading edge, clearly indicating the highly asymmetric outline 22 of the widening portion 19 of the cooling holes 1, 2.

Figure 5:
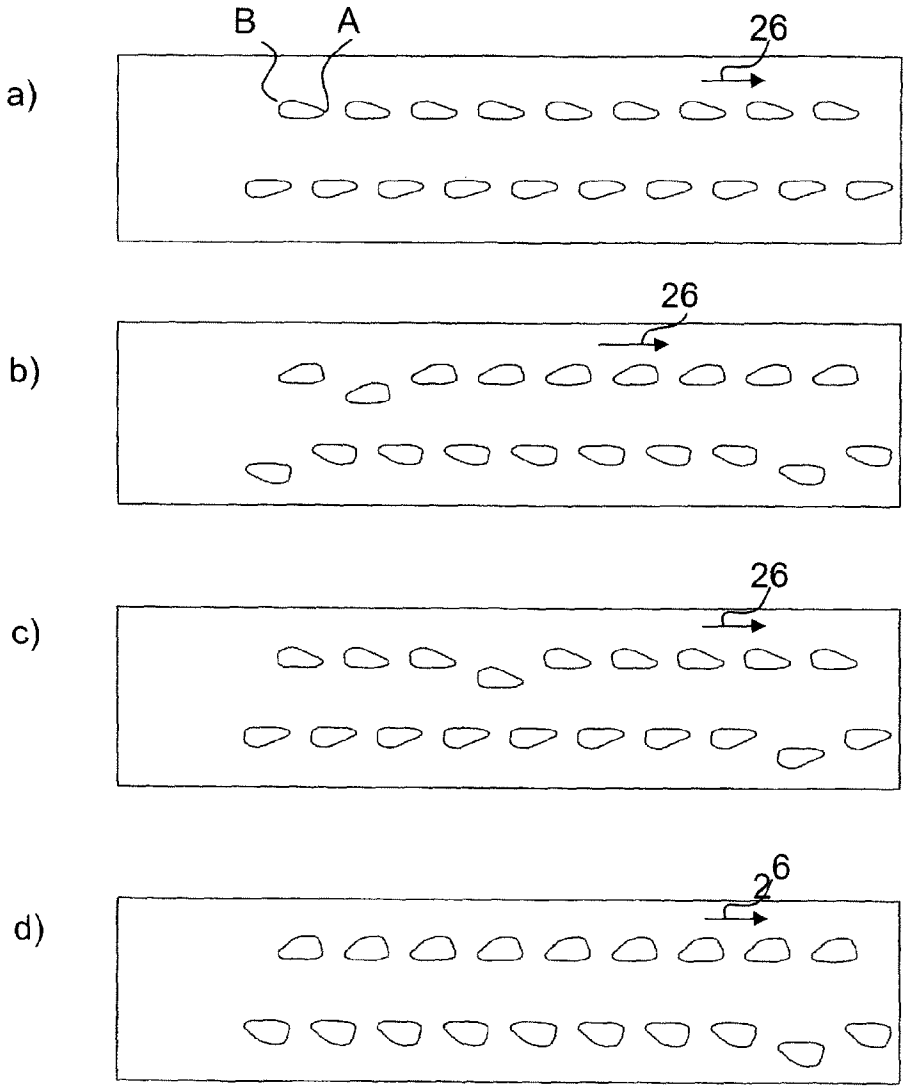
FIG. 5 shows various different patterns of arrangement of cooling holes in a view along the arrow A in FIG. 1.

FIG. 5 shows four different possibilities for arranging the two rows of cooling holes on the leading edge. FIGS. 5 *a*) and *b*) both show a situation in which the angle $\beta$ is 10° and also $\gamma$ is 10°. The difference between these two embodiments is that in FIG. 5*a* the lateral inclination was drilled or provided at the backside edge B of the hole. This leads to a widening rather in the backside area.

In contrast to that, in FIG. 5*b* the lateral inclination was drilled at the forward edge A of the hole. This leads to a widening in the forward direction of the hole.

As mentioned above, also intermediate positioning of the lateral inclination is possible between the two extremes at A or B.

FIGS. 5*c*) and *d*) indicate a situation, in which the forward inclination angle $\beta$ is 10°. However, in this case the lateral inclination angle $\gamma$ is wider, leading to broader outlines 22 of the cooling holes. Again, the difference between these two embodiments is that in FIG. 5*c* the lateral inclination was drilled or provided at the backside edge B of the hole. This leads to a widening rather in the backside area. In contrast to that, in FIG. 5*d* the lateral inclination was drilled at the forward edge A of the hole. This leads to a widening in the forward direction of the hole. Also here intermediate positioning of the lateral inclination is possible between the two extremes at A or B.

Figure 6A:
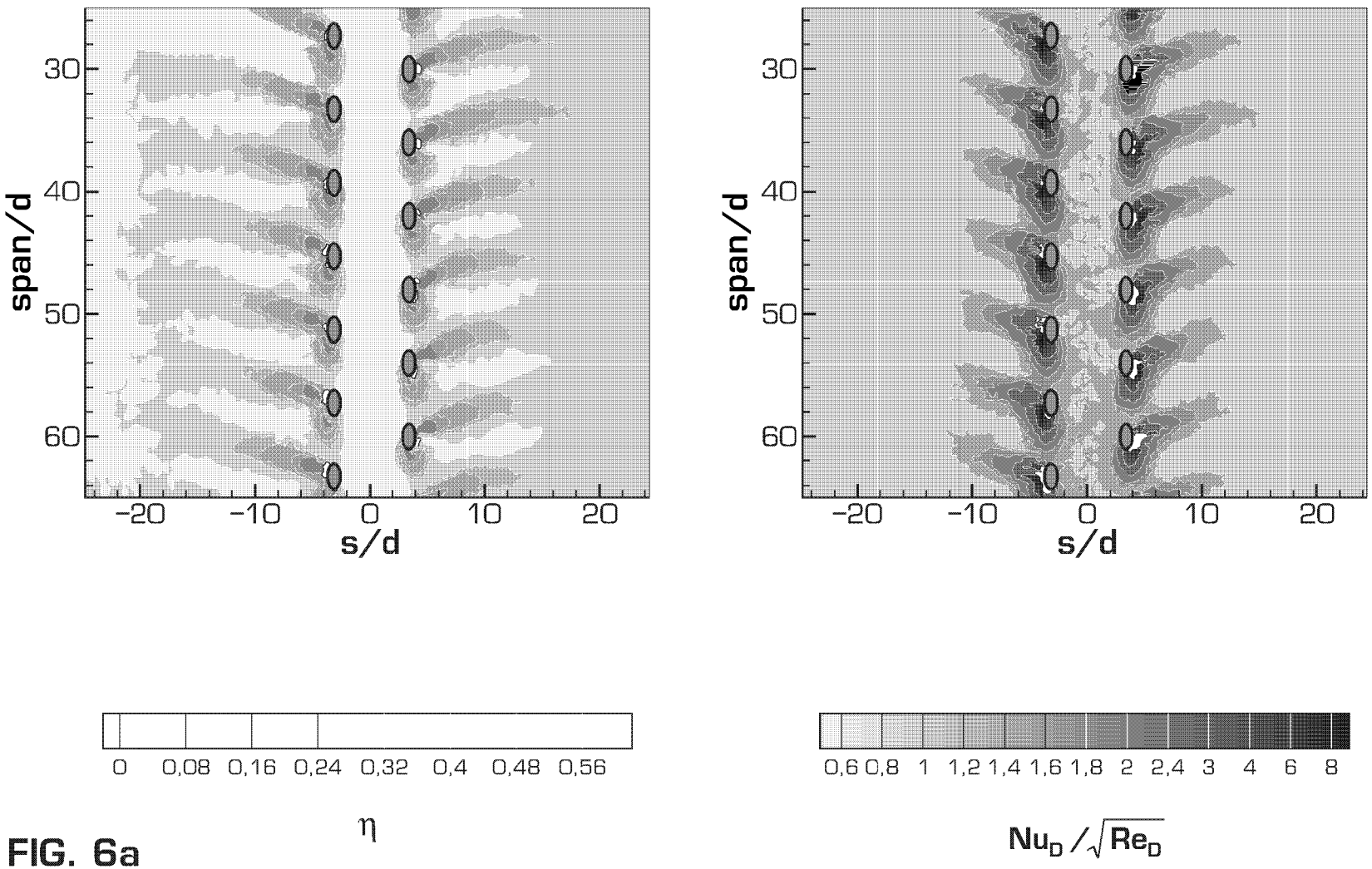
FIG. 6 shows the adiabatic film cooling effectiveness (left) and heat transfer coefficient (right) for a blowing ratio of 2.0 and an angle of incidence of 0° of cylindrical holes (a) and twin widened cooling holes according to the invention (b)
Figure 6B:
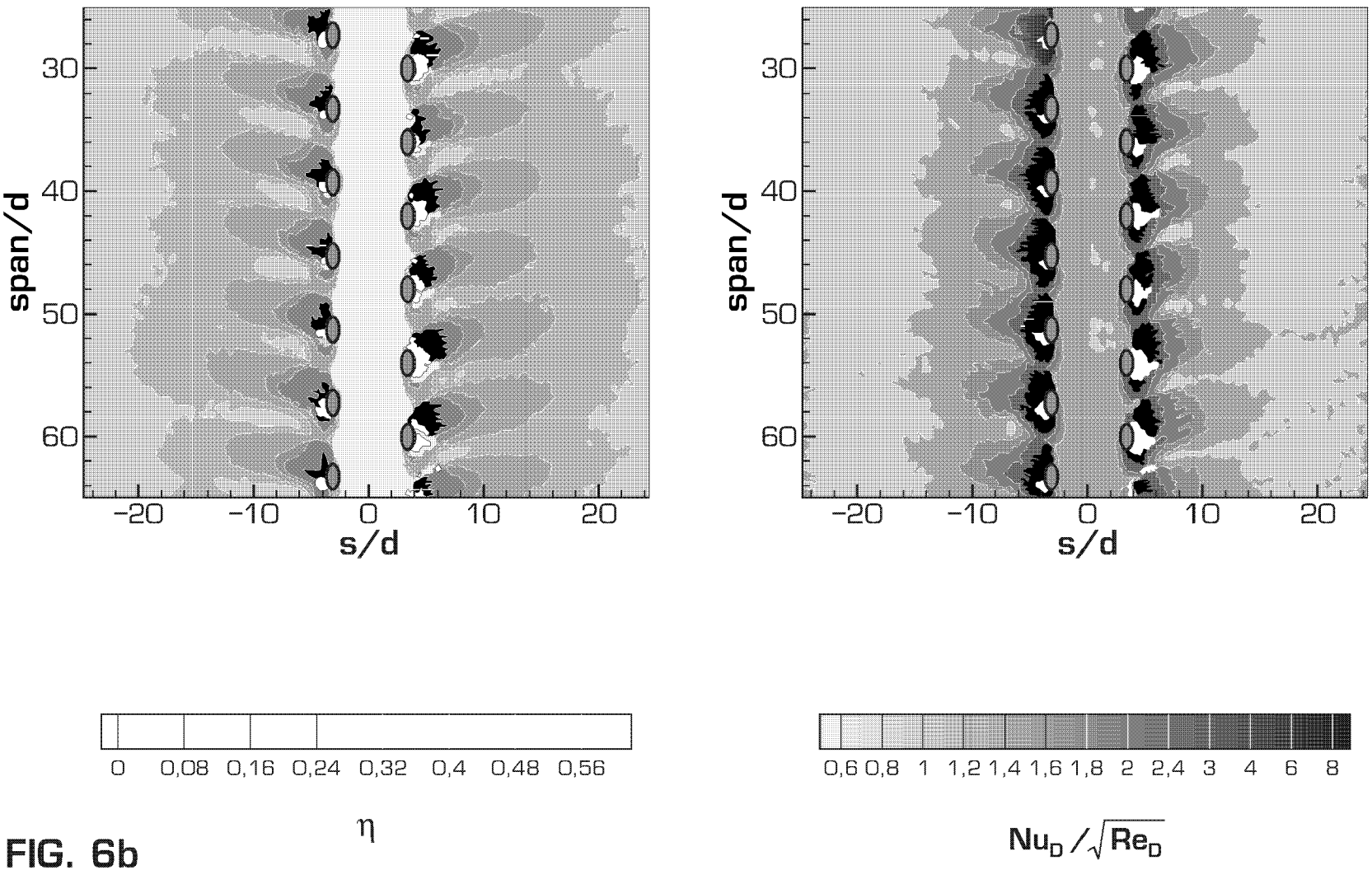
Figure 7A:
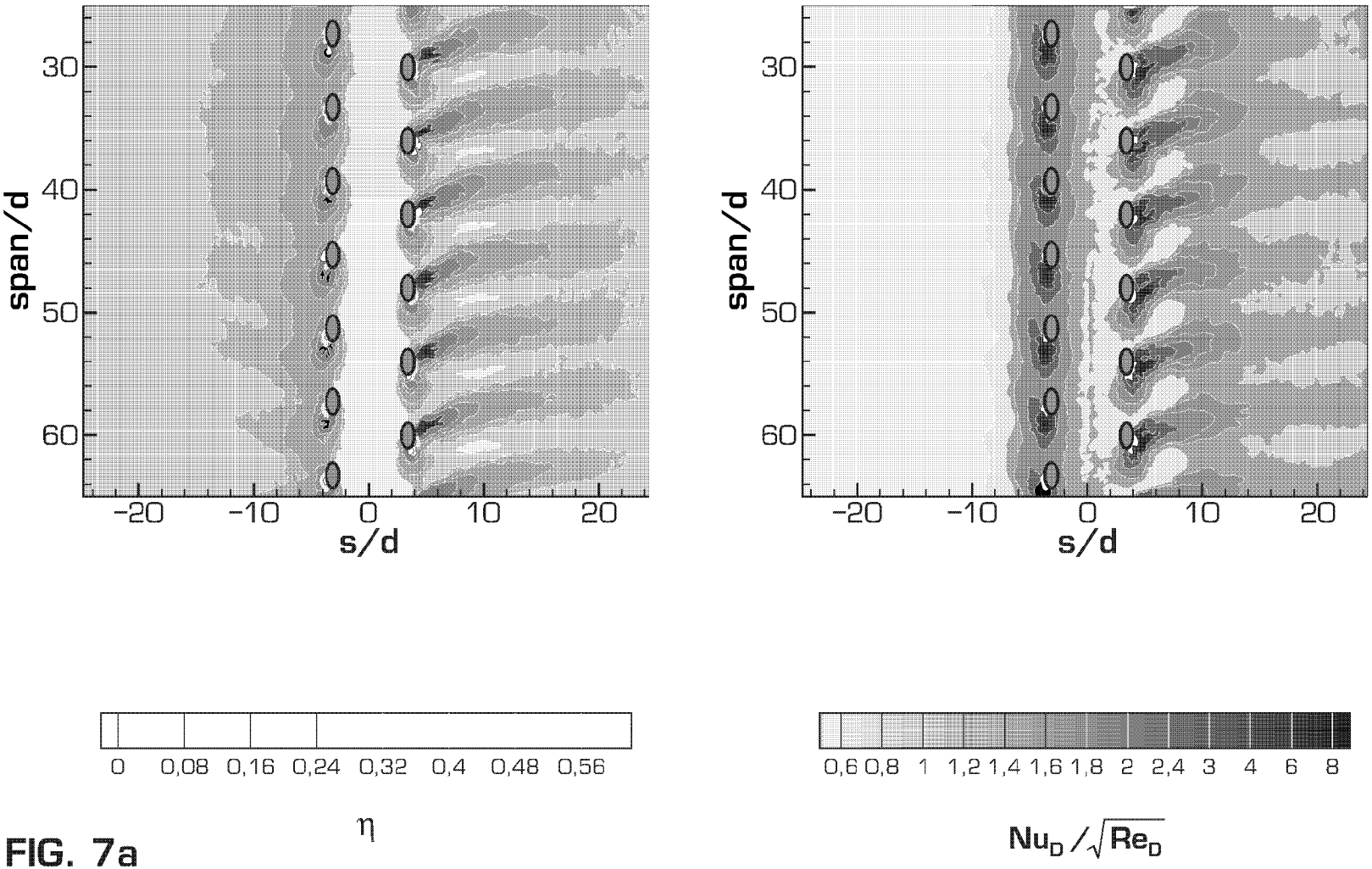
FIG. 7 shows the adiabatic film cooling effectiveness (left) and heat transfer coefficient (right) for a blowing ratio of 2.0 and an angle of incidence of 5° of cylindrical holes (a) and twin widened cooling holes according to the invention (b).
Figure 7B:
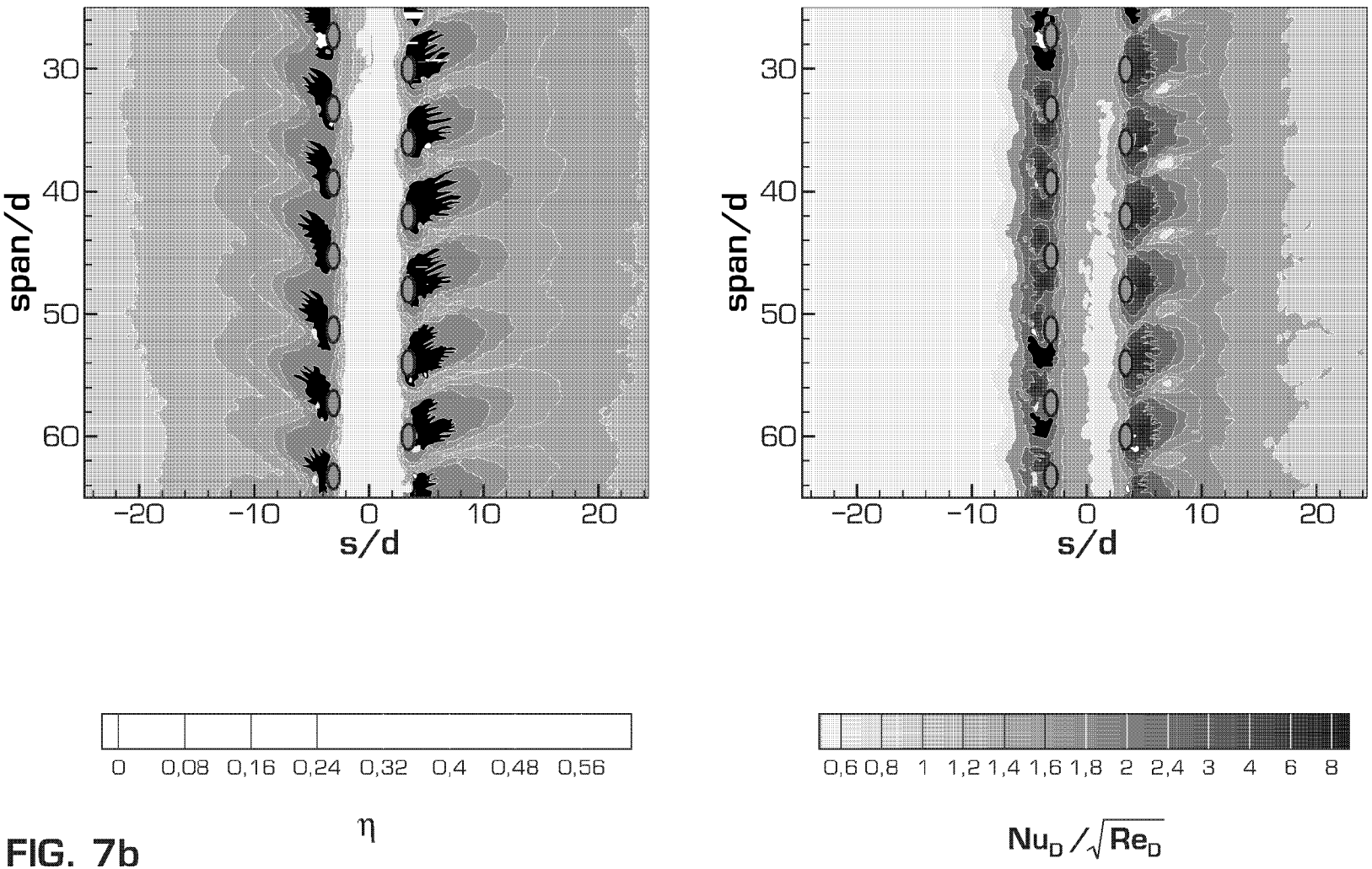

FIGS. 6 and 7 show experimental results, documenting the unexpected and highly efficient film cooling that can be achieved with the cooling hole structure as described herein. Using a test model assembly in a hot main flow, on the one hand the film cooling effectiveness $\eta$, which is defined as the temperature difference between the hot gas temperature and the adiabatic wall temperature, divided by the difference of the hot gas temperature and the cooling gas temperature, as well as the heat transfer coefficient defined as the Nusselt number, based on the leading edge diameter $Nu_D$, divided by the square root of the Reyonlds' number, based on the leading edge diameter $Re_D$, always displayed on the right side.

In FIG. 6 a situation is shown, in which the angle of incidence of the hot gas is 0°, and a blowing ratio of 2.0 is used. In FIG. 6*a*) a situation is shown, in which there is provided cylindrical cooling holes with an angle $\alpha$ of 30° and no downstream tilt in the lateral direction, and in b) a set up essentially according to FIG. 5*a*) is used.

In FIG. 7, the same measurements are carried out with an angle of incidence of the hot air of 5°, so the hot air impinges asymmetrically onto the two rows of cooling holes.

As one can see from the two FIGS. 6 and 7, on the one hand the proposed structure is able to provide a very broad coverage of film cooling with efficient adiabatic film cooling and a high heat transfer coefficient over broad areas, not only downstream but also in a radial direction. As one can see further more from FIG. 7, the cooling system is also highly robust with respect to a change in the angle of incidence of the hot air, which provides much more flexibility and stability of the cooling system with respect to different operating conditions.

In summary the following shall be noted: The proposed film cooling holes extend from the internal cooling passage to the airfoil outer surface at a particular radial and stream-wise angle to the surface of the blade. The holes are radially staggered to each other and have a hole length-to-diameter ratios typically ranging from 2 to 6.

In some embodiments in accordance with the present invention, the holes are shaped with diffusion angles in both the stream-wise (i.e., parallel to the hot gas flow) and span-wise (or radial) directions, as shown by FIGS. 2, 3, and 4. Several other design variants of shaped cooling holes are possible.

Test results of film cooling effectiveness and heat transfer coefficients from a laboratory cascade test rig show potential benefits of the current invention.

The following main aspects emerge:

- Enhanced film cooling of leading edge of a gas turbine blade
- Double row of film cooling holes radially staggered by 1 hole pitch from each other on leading edge of a airfoil.
- The shaped holes are diffused in both the radial (or span-wise) and stream-wise directions. In the stream-wise direction it is diffused at only one corner point and not along the entire hole shape (see FIGS. 2 and 3).
- The shaped holes have diffusion angles ranging from 5 degree to 20 degree, and preferably 10 degrees, in both the span-wise and stream-wise directions.
- Each row of holes is located at least 3× hole diameter from the stagnation point on the airfoil and preferably 3.25× hole diameters.
- The holes are radially inclined by 60 degrees (and can range from 50 to 70 degrees) from the horizontal plane (or hot gas stream-wise or downstream direction).

The showerhead hole drilling angle to the surface is between 85 and 105 degrees and preferably at 90 degree to the airfoil surface.

The diffusion angles of the shaped holes with diffused radial and span-wise angles ranging from 5 degree to 20 degree, and preferably 10 degrees.

Hole length to diameter ratios ranging from 1.5 to 5.

Holes include a cylindrical portion (at the cooling flow inlet) and a diffusion section at the hole outlet.

The hole cross-sectional area ratio of the diffused to the cylindrical portion is between 1.5-2.45 and preferably around 1.95.

LIST OF REFERENCE NUMERALS

1 showerhead pressure side hole A
2 showerhead suction side hole B
3 cooling air passage
4 suction side hole close to leading-edge
5 suction side hole remote from leading-edge
6 gas turbine airfoil
7 pressure side
8 suction side
9 cooling air discharge from 1
10 cooling air discharge from 2
11 exit portion of 1
12 exit portion of 2
13 entry portion of 1
14 entry portion of 2
15 pressure side sidewall of 1
16 suction side sidewall of 1
17 principal axis of 1, 2
18 cylindrical portion of 1, 2
19 widening portion of 1, 2
20 forward inclination axis
21 lateral inclination axis
22 outline of 11, 12
23 radial inner side of 6, root side of 6
24 radially outer side of 6, tip side of 6
25 stagnation line
26 cooling air flow
27 hot gas flow towards pressure side
28 hot gas flow towards suction side
29 trailing edge
A forward edge of hole
B backward edge of hole
C cross section in cylindrical area
D cross section in diffused area
$\alpha$ inclination angle of 17
$\beta$ forward inclination angle of 20 with respect to 17, forward diffusion angle
$\gamma$ lateral inclination angle of 20 with respect to 17, lateral diffusion angle While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A gas turbine airfoil comprising:

a pressure sidewall and a suction sidewall defining and extending from a root to a tip and from a leading edge region to a trailing edge;

at least one cooling passage between the pressure sidewall and the suction sidewall configured and arranged to permit cooling air to pass through and cool the airfoil from within;

wherein at least one of the at least one cooling passage extends along the leading edge of the airfoil;

a plurality of film cooling holes extending from the at least one cooling passage along the leading edge region to the outer surface of the leading edge region, the plurality of film cooling holes each having a shape that is diffused in a radial outward direction of the leading edge of the airfoil at least over a part of the length of the film cooling hole;

wherein the plurality of film cooling holes each comprise a principal axis and a shape that is asymmetrically diffused, said shape being diffused in the radial outward direction from the principal axis along a forward inclination axis, and additionally diffused in a second lateral direction from the principal axis along a lateral inclination axis; and wherein the shape is diffused cylindrically in the radial outward direction along the forward inclination axis and in the second lateral direction along a lateral inclination axis.

2. An airfoil according to claim 1, wherein the shape between the two cylindrical diffusions is smoothed.

3. An airfoil according to claim 2, wherein the smoothed shape between the two cylindrical includes connected surfaces essentially tangential to both cylindrical diffusions.

4. An airfoil according to claim 1, wherein the principal axis is radially inclined by 50-70° from the horizontal plane.

5. An airfoil according to claim 1, wherein the forward inclination axis is tilted from the principal axis towards the radial direction of the airfoil, and wherein the angle ($\beta$) between the principal axis and the forward inclination axis is in the range of 5-20°.

6. An airfoil according to claim 5, wherein the angle ($\beta$) between the principal axis and the forward inclination axis is in the range of 5-15°.

7. An airfoil according to claim 1, wherein the lateral inclination axis is tilted from the principal axis along a direction perpendicular to a stagnation line on the leading-edge, and wherein the angle ($\gamma$) between the principal axis and the lateral inclination axis is in the range of 5-20°.

8. An airfoil according to claim 7, wherein the angle ($\gamma$) between the principal axis and the lateral inclination axis is in the range of 5-15°.

9. An airfoil according to claim 1, wherein the airfoil defines a stagnation line, and wherein the plurality of cooling holes comprises a first row of cooling holes located on the pressure side of the stagnation line and a second row of cooling holes located on the suction side of the stagnation line.

10. An airfoil according to claim 9, wherein the cooling holes in the first and second rows are staggered along the radial direction.

11. An airfoil according to claim 10, wherein the holes in the first and second rows are staggered by one hole pitch from each other.

12. An airfoil according to claim 9, wherein each row of holes is located at least 3 hole diameters from the stagnation line.

13. An airfoil according to claim 12, wherein each row of holes is located 3-3.5 hole diameters from the stagnation line.

14. An airfoil according to claim 9, wherein the first and second rows are equally distanced from the stagnation line.

15. An airfoil according to claim 14, wherein the holes of each of the first and second rows are equally distanced from the stagnation line.

16. An airfoil according to claim 1, wherein each of the plurality of cooling holes comprises a cylindrical section at an entry portion facing the cooling passage.

17. An airfoil according to claim 1, wherein each of the plurality of cooling holes has a hole length-to-diameter ratio ranging from 1.5-6.

18. An airfoil according to claim 17, wherein each of the plurality of cooling holes has a hole length-to-diameter ratio ranging from 2-5.

19. An airfoil according to claim 1, wherein the ratio of the cross-section (D) in the widening portion of each of the plurality of cooling holes to the cross-section in the cylindrical section of the holes is in the range of 1.5-2.45.

20. An airfoil according to claim 19, wherein the ratio of the cross-section (D) in the widening portion of each of the plurality of cooling holes to the cross-section in the cylindrical section of the holes is in the range of 1.8-2.0.

21. An airfoil according to claim 19, wherein the lateral inclination axis is tilted from the principal axis along a direction such that, at the transition of the cylindrical and the widening portion, the axis of the cylindrical section and the axis of the inclination cross.

22. An airfoil according to claim 1, wherein the lateral inclination axis is located at or between a forward edge (A) and a backward edge (B) of the exit portion of each hole.

23. A method for producing cooling holes in an airfoil, the method comprising:

drilling a cylindrical, fully penetrating hole defining a principal axis and a cylindrical section; and subsequently performing two cylindrical drillings along a lateral inclination axis and along a forward inclination axis from the outer side of the airfoil.

24. A method according to claim 23, further comprising:

smoothing a widening inner surface of a diffusion region of the cooling holes.

* * * * *